United States Patent [19]

Schaffer

[11] Patent Number: 4,915,252

[45] Date of Patent: Apr. 10, 1990

[54] BEVERAGE CAN STOPPER

[76] Inventor: Joel L. Schaffer, 2880 Folsom, #202, Boulder, Colo. 80304

[21] Appl. No.: 329,912

[22] Filed: Mar. 28, 1989

[51] Int. Cl.[4] ..... B65D 39/00

[52] U.S. Cl. ..... 220/307; 220/DIG. 19

[58] Field of Search ..... 220/254, 278, 307, DIG. 19; 215/355

[56] References Cited

U.S. PATENT DOCUMENTS

| | | | |
|---|---|---|---|
| 2,173,843 | 9/1939 | Hothersall | 220/DIG. 19 X |
| 3,106,311 | 10/1963 | Fairchild | 220/307 |
| 3,132,763 | 5/1964 | Quiroz | 220/307 |
| 3,262,612 | 7/1966 | Tabor | 220/307 X |
| 3,428,212 | 2/1969 | Rohrlick | 220/307 |
| 3,442,377 | 5/1969 | Angelus | 220/DIG. 19 X |
| 3,445,030 | 5/1969 | Lutzker | 220/307 |
| 3,659,738 | 5/1972 | Friedmann et al. | 220/DIG. 19 X |
| 4,103,804 | 8/1978 | Fournier et al. | 220/307 X |
| 4,113,134 | 9/1978 | Heintzelman | 220/DIG. 19 X |

*Primary Examiner*—Stephen Marcus
*Assistant Examiner*—Nova Stucker
*Attorney, Agent, or Firm*—Francis A. Sirr; Earl C. Hancock

[57] ABSTRACT

A stopper seals the opening left in the lid of a metal can upon operation of an integral metal tab that is attached to the top surface of the lid. The stopper comprises a resilient plug having a thickness greater than the thickness of the lid. The plug includes (1) a top portion having a planar size considerably greater than the planar size of the lid opening and including a recessed area to accommodate a section of unsevered metal by which the tab remains attached to the lid; (2) a bottom portion of a planar size greater than the planar size of the opening, thus permitting manual insertion of the bottom portion into the opening so as to sealingly engage the bottom surface of the lid and including an extended area to force the section of unsevered metal up and generally against the under surface of the lid; and (3) a mid-portion that interconnects the top and bottom portions with a thickness that approximates the thickness of the lid and having a planar size that approximates the size of the opening of the mid-portion to sealingly engage the opening, including the section of unsevered metal, throughout the thickness of the lid. A manual actuator extends upward for facilitating manual insertion and removal of the plug relative the opening.

10 Claims, 1 Drawing Sheet

BEVERAGE CAN STOPPER

FIELD OF THE INVENTION

The present invention pertains to the field of receptacles, and more particularly to stopper closures for cylindrically shaped can receptacles, for example cans that are used to hold carbonated beverages and that are opened by manual actuation of a pivoted tab that remains attached to the can's lid after the can has been opened.

BACKGROUND OF THE INVENTION

A problem common to many types of receptacles is that of providing adequate closure means once the receptacle has been opened, and before the entire content of the receptacle has been consumed. This problem is particularly acute in the case of carbonated beverages where the content of the receptacle will deteriorate if the receptacle is not adequately sealed.

A common receptacle for holding carbonated beverages is a metal can, usually an aluminum can. A number of pull-tab tops have been provided in the past for such cans. A contemporary type can protects the environment by providing a pull-tab or pull-ring that remains attached to the can after the can has been opened. In this type of can a lid tab bends down into the can and also remains attached to the lid after opening. Cans of this type are superior to the prior cans in that no metal member is discarded after the can is opened. Prior to this type of can, a metal tab was discarded after the can was opened, and many times the tab was swallowed by fish or animals, or often the metal tab resulted in injury to the bare foot of an individual.

A common size contemporary can is a ten ounce beverage can having a relatively thin metal top, usually aluminum, to which a tab or ring is pivotally attached. This tab lies flat against the can's lid or top during storage and the like. When the can is to be opened, the tab is manually pivoted upward. This action provides a force against a severable tab portion of the lid. This severable portion of the lid is connected to the remainder of the lid in a sealed manner by way of a score line that is formed in the metal lid. This score line outlines a generally wedge shaped or key-hole shaped opening that will be formed in the lid upon manual operation of the tab. Operation of the manual tab severs this lid or tab portion from the lid, and bends it down into the can, leaving the lid portion connected to the lid by a small section of unsevered metal. The manual tab is then manually returned to its original flat position adjacent the top surface of the lid.

Prior art closure members or stoppers do not succeed in sealing the opening in such a contemporary can in that the prior art stoppers do not adequately seal the opening at the opening location which is adjacent the downwardly folded portion of the lid. A number of prior art closure members will now be described.

The prior art shows the concept of a snap-in unitary resilient member having a grooved peripheral edge and a vertically extending tab. This is shown, for example, in U.S. Pat. No. Re. 27,301. This patent shows a resilient closure plug having a peripheral groove that receives the edge of the opening in a pop-top can. A tab on one end of the plug facilitates manual removal of the resilient plug. U.S. Pat. No. 3,428,212 is also of this general type.

The stopper of the present invention improves upon this type of prior art stopper construction in that the stopper of the present invention is uniquely constructed and arranged to accommodate the residual downwardly projected lid tab that remains after a contemporary can is opened. That is, these prior art devices do not seal properly in a contemporary can where a manual tab and a loosened lid tab remain in place after the can has been opened.

U.S. Pat. No. 3,659,738 is also of interest in that this patent describes a closure device for a can of the type in which a severed lid tab remains attached to the lid after opening. The closure device of this patent comprises a terraced stopper having three triangular sides, two sides having multiple grooves of receding triangular shape, while the third side is smooth and abuts the downwardly projecting lid tab. Again, no attempt is made to control the position of the bent down lid tab. In the present invention, as will be apparent, the stopper is uniquely constructed and arranged to force the lid tab up under the lid, thus providing a known sealing force against the lid tab.

A stopper for sealing a pop-top can that has been opened to expose an essentially wedge or key-hole shaped opening in the top of the can, the stopper substantially matching the shape of the hole and including flanges for engaging the upper and lower surfaces of the can's lid, and the stopper including a handle member for inserting or removing the stopper, is shown in a number of prior patents, such as; U.S. Pat. No. 4,103,804 wherein a wedge shaped resilient stopper having wings and a U-shaped spring internal to the wigs; U.S. Pat. No. 3,664,541 which shows a resilient plug having layers of decreasing dimension to accommodate tab openings of various sizes, and having a handle extending along the plug's longitudinal axis; U.S. Pat. No. 3,650,432 which shows a flexible, pan-like plug having internal ribs arranged in a grid pattern, and having a flat tab on its side to facilitate removal; U.S. Pat. No. 3,622,034 which shows a deformable one piece stopper having overlying legs to engage the top of the can, and a the lower lip that sealingly engages the underside of the can lid; U.S. Pat. No. 3,442,377 which shows resilient stoppers that force fit into a pull tab hole or key-hole shaped opening, etc.; U.S. Pat. No. 3,338,462 which shows a flat plastic member having a stopper at one end and a grippable tab at the other end; U.S. Pat. No. 2,841,307 which shows a deformable stopper having a hollow interior; and U.S. Pat. No. 2,173,843 which shows another deformable stopper.

While the devices of the prior art are generally satisfactory for their intended purposes, the prior art does not address nor solve the problem o sealing a can of the contemporary type, in which, once the can is opened, the stopper must accommodate both a manual operator or tab that remains attached to the top surface of the lid, and a portion of the lid that has been severed therefrom and now extends down into the can, to a position under the lid.

As will be apparent, the beverage can stopper of the present invention is uniquely constructed and arranged to effectively seal such a contemporary can.

DETAILED DESCRIPTION OF THE INVENTION

The present invention will be described with reference to a contemporary aluminum beverage can of the ten ounce type. However the invention is not to be limited thereto.

Figure 1:
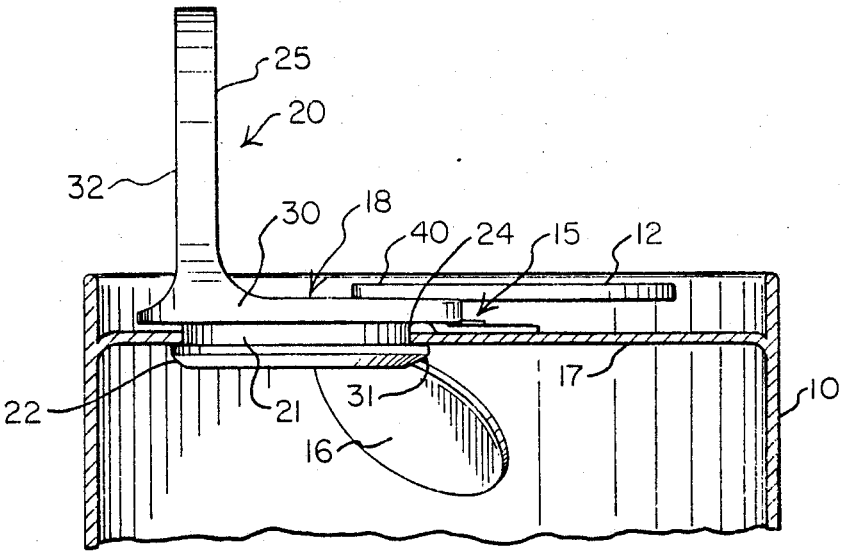
FIG. 1 is a view of the stopper of the invention, showing the stopper in place in a can that has been opened and then sealed by the use of the stopper.

FIG. 1 shows a side view of the top portion of such an aluminum tab-can 10, the can being shown in section. In this view, can 10 has been opened, and resilient stopper 20 in accordance with the invention has been manually inserted to seal the opening in the top of can lid 17.

Can 10 includes an integral metal tab or ring 12 which is attached to lid 17 in a manner to allow tab 12 to manually pivot around a rivet-like attachment member 15. This manual operation of tab 12 breaks the metal score-seal by which metal tab portion 16 of can lid 17 is attached to the remaining portion of the can lid.

As tab 12 is manually rotated CCW from the FIG. 1 position, lid portion 16 is broken away from the remainder of lid 17, and is then bent and deflected down out of the way, into the body of the can, as is shown. In this position, portion 16 remains attached to lid 17 by way of small portion of unsevered metal. Tab 12 is now bent CW back to its original horizontal position, as is shown in the figure, while bent down lid portion 16 remains stationary.

A stopper in accordance with the invention is shown at 20. Stopper 20 includes a plug portion 18 having a groove 21 and an outwardly bulged ridge portion 22 that generally encircles plug portion 18. As will be described, ridge 22 is provided with a discontinuity at one portion thereof to assist in proper insertion of plug portion 18 into the opening in lid 17. Plug portion 18, groove 21 and ridge 22 are configured to conform to the shape of the opening in lid 17, i.e. the opening in lid 17 that is left as lid portion 16 is bent down into can 10.

In accordance with the invention, an effective seal of this lid opening is provided due to the fact that the end portion 24 of stopper 20 (i.e. the entry end portion) is configured to slide under tab 12. In this position, end portion 24 operates to sealingly engage the unbroken metal area that attaches and retains bent tab 16 to lid 17.

Stopper 20 is provided with an upwardly directed projection or handle portion 25 that facilitates manually snapping or pivoting of stopper 20 upward about end portion 24 to remove the stopper from lid 17, as well as downward pivoting of stopper 20 to sealingly engage the stopper in the lid opening.

As a result of operation of stopper 20, an opened tab-can 10 is resealed so that its contents are isolated from the atmosphere, for example the carbonation of the can's contents is preserved.

Stopper 20 of the invention is uniquely configured to accommodate and control the position of the residual portion of the downwardly projected tab 16 that remains after can 10 is opened. More specifically, a stopper in accordance with the invention provides an end portion 24 that engages and bends, or tends to bend, tab portion 16 upward inside of the can, as the stopper is inserted into the opening, thereby causing stopper 20 to sealingly engage the underside of lid 17 in the location of lid portion 16.

Prior art stopper devices do not provide a construction and arrangement whereby contemporary cans (i.e. those cans that leave a ring or tab 12 and a severed tab 16 in place after the can is opened) are sealed, since prior art stoppers do not bendingly engage the downwardly projected tab 16, and thus do not effectively seal that portion of the opening.

An example of an attempt in the prior art is shown in above mentioned U.S. Pat. No. 3,659,738 where a severed tab remains attached to the can lid. In this device the stopper merely configures itself to the position of the severed tab by way of a terraced stopper having three triangular sides, two sides having multiple grooves of receding triangular shape while the third side is smooth to accommodate abutting into the downwardly projecting tab.

Can 10 is shown as a contemporary can, for example a can having an integral metal tab or ring member 12 that is attached to the top side of lid 17 in a manner to allow tab 12 to pivot about the lid attachment member 15, thereby breaking a seal by which metal lid portion 16 is attached to the remaining portion of the lid. During this operation, lid portion 16 is bent down into can 10, to a position generally under the top side of the lid. A wedge of key-hole shaped opening is thus left in the plane of lid 17, this opening being in the shape of lid portion 16. After opening, bent-down lid portion 16 remains attached to lid 17 by a small section of unsevered metal.

In a preferred embodiment of the invention, stopper 20 comprising a resilient, generally uniform thickness plug 18 having a thickness greater than the thickness of lid 17, for example about three times as thick. Plug 18 is made up of three distinctly operative portions, as will now be described.

The plug's top portion 30 is of a planar size considerably greater than the planar size of the opening in lid 17, so as to prevent the top portion 30 of plug 18 from entering the opening. This relatively large size of top portion 30 insures that top portion 30 will surround the opening in lid 17 so as to sealingly engage the top side of the lid.

As a feature of the invention, this top portion 30 includes a recessed area 34 (best seen in FIG. 3) at right hand end 24 thereof (i.e. the right hand end as seen in FIG. 1) to accommodate the section of unsevered metal by which the bent-down lid portion 16 remains attached to lid 17, and to accommodate the end 40 of metal tab 12 (see FIG. 1). In a preferred embodiment this recessed area at end 24 of the plug's top portion 30 includes a first recessed area in the top surface of top portion 30 that connects to a second recessed area that extends throughout the thickness of top portion 30, this second recessed area extending generally into groove 22 that is formed by the plug's mid-portion at the end 24 of top portion 30.

Plug 18 also includes a bottom portion or ridge 22 which is of a planar size that is greater than the planar size of the opening, but is of a smaller size than top portion 30, so as to permit manual insertion of bottom portion 22 into the opening, as resilient bottom portion 22 yields during insertion into the opening. Bottom portion 22 is adapted to surround the opening so as to sealingly engage the bottom side of lid 17 adjacent the opening.

As a feature of the invention the plug's bottom portion 22 includes an extended area 31 (best seen in FIG. 3) that is located in spaced coincidence with the recessed area that is located in the end 24 of the plug's upper portion 30. This extended area 31 of plug portion 22 operates to force the section of unsevered metal up and generally against the under side of lid 17 when bottom portion 22 is inserted into the opening in lid 17.

Plug 18 also includes a mid-portion that interconnects the top portion 30 and bottom portion 18. This mid-portion of plug 18 has (1) a thickness that approximates the thickness of lid 17, (2) a planar size that is smaller than the planar size of the plug's bottom portion 22, and (3) a planar size which approximates the size of the opening. This mid-portion thereby defines a groove 21 having the general shape of the opening in lid 17. Groove 21 encircles plug 18 at a position generally in the middle of the plug's thickness, and intermediate its top portion 30 and its and bottom portion 22. This mid-portion is adapted to sealingly engage the opening in lid 17, including the section of unsevered metal adjacent end 24, throughout the thickness of lid 17.

As a feature of the invention the plug's bottom portion 22 includes a cut-away section 33 (best seen in FIG. 4) that extends generally into the groove 21 that comprises the plug's mid-portion. This cut-away section 33 joints groove 21 at a location that is coincident with the defined one end 24 of top portion 30. This construction and arrangement facilitates the ease of initial insertion of plug end 24 into the opening in lid 17.

Handle or manual actuator 25 extends upward from the top surface of plug 18 at the end of thereof that is generally opposite end 24. This actuator facilitates manual insertion and removal of plug 18 relative the lid opening, as plug 18 rotates generally about the location of the section of unsevered metal that holds lid portion 16 to lid 17.

Preferably manual actuator 25 includes a planar surface, such as 32, facilitating the placement of human readable indicia such as instructions and/or advertising. Manual actuator 25 is constructed and arranged to provide a high friction surface to facilitate the insertion and removal of plug 18 relative the lid opening, and in a preferred embodiment plug 18 and manual actuator 25 are integrally molded of a natural or a synthetic elastomer to form a solid, resilient stopper 20.

Figure 2:
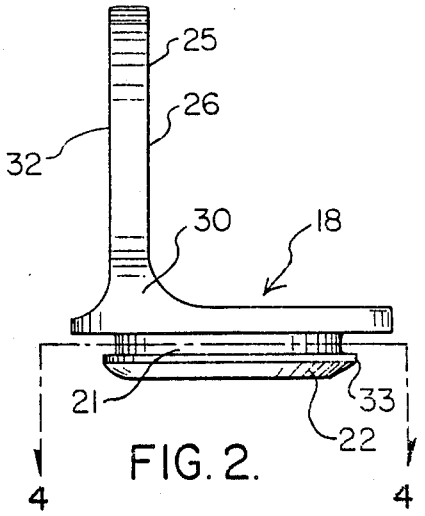
FIG. 2 is a side view of the stopper of FIG. 1 where the stopper is shown apart from its use in sealing a can.

FIG. 2 is a side view of stopper 20, similar to FIG. 1. In a preferred embodiment, the stopper's bottom portion 22 was provided with a peripheral ridge having a 0.04 inch radius, and grooved mid-portion 22 includes a groove of a similar internal radius. The vertical thickness of plug portions 21 and 22 was 0.08 inch, and the vertical thickness of upper plug portion was 0.10 inch. The overall vertical height of the stopper was 0.75 inch. The right-to-left length of the stopper as shown in FIG. 2 was 1.09 inch. Surface 26 was provided with ridges to facilitate increased friction to the hand of a user.

Figure 3:
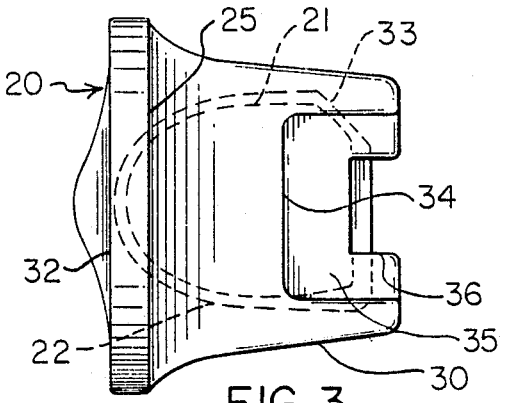
FIG. 3 is a top view of the stopper of FIGS. 1 and 2.

With reference to FIG. 3, a top view of the stopper, in this view it can be seen that the stopper is of a generally oval horizontal shape. The width of a preferred embodiment of the stopper (i.e. the up-down dimension of FIG. 3) was 0.90 inch.

FIG. 3 more clearly shows the recessed area 34 that is formed in top plug portion 30, at right hand end thereof, to accommodate the section of unsevered metal by which the bent-down lid portion 16 of FIG. 1 remains attached to lid 17, and to accommodate the end 40 of tab 12. This recessed area 34 is made up of a first recessed area 35 in the plug's top portion 30. Recessed area 35 accommodates tab portion 40 and connects to a second recessed area 36 that extends throughout the thickness of top portion 30. This second recessed area 36 extends generally into the groove 22 that forms the plugs mid-portion.

The bottom or ridge portion 22 of plug 18 is of a planar size that is greater than the planar size of the can opening, but is of a smaller size than plug's top portion 30, so as to permit manual insertion of bottom plug portion 22 into the can opening, as resilient bottom portion 22 yields during insertion into the opening. Bottom portion 22 is adapted to surround the can opening so as to sealingly engage the bottom side of the can lid, adjacent the opening.

Figure 4:
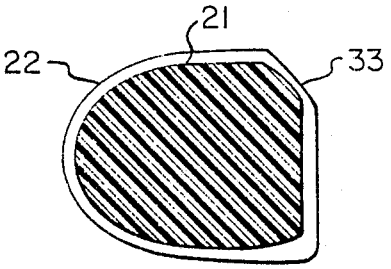
FIG. 4 is a section view of the stopper taken on the line 4—4 of FIG. 2.

As can be clearly seen in FIGS. 3 and 4, the plug's lower or ridge portion 22 is provided with a cut-away discontinuity 33 at one portion thereof to assist in proper insertion of lower plug portion 22 into the can opening.

In operation, the discontinuity portion 33 of the plug's lower portion 22 is first inserted into the can opening. By the use of handle 25, the user then pivots stopper 20 about this engagement with the can lid, and the stopper easily is positioned in sealing relation to the can opening. During this operation, the portion 34 of the plug's upper portion 30, the vertically adjacent portion of groove 21, and the vertically adjacent portion 31 of the plug's lower portion 22 operate to effectively control and seal to the bent-down portion of the can lid.

Without limitation thereto, in a preferred embodiment stopper, 20 of the invention was formed of a urethane or styronic elastomer having a durometer in the range of 45 to 50. Materials of a somewhat higher durometer are also suitable.

While the invention has been described with reference to preferred embodiments thereof, it will be readily appreciated that those skilled in the art will visualize other embodiments within the spirit and scope of the invention. Thus, the spirit and scope of the invention is to be as defined in the following claims.

What is claimed is:

1. A stopper for use in sealing the opening that is left in the lid of a metal can upon operation of an integral metal tab or ring member that is attached to the top side of said lid in a manner to allow the tab to pivot about a lid attachment member, thereby breaking a seal by which a metal lid portion is attached to the remaining portion of said lid, thereby bending said lid portion down into said can and generally under the top side of said lid, while leaving an opening in the plane of said lid that is in the shape of said lid portion, said lid portion remaining attached to said lid by a small section of unsevered metal, the stopper comprising;

a resilient, generally uniform thickness plug having a thickness greater than the thickness of said lid, and having a top portion of a planar size considerable greater than the planar size of said opening, so as to prevent said top portion of said plug from entering said opening, said top portion being adapted to surround said opening so as to sealingly engage the top side of said lid, and including a recessed area at one end thereof to accommodate said section of unsevered metal by which said lid portion remains attached to said lid, a bottom portion of a planar size that is a predetermined size greater than the planar size of said opening, so as to permit manual insertion of said bottom portion into said opening as said resilient bottom portion yields during insertion into said opening, said bottom portion being adapted to surround said opening so as to sealingly engage the bottom side of said lid, said bottom portion having an extended area located in spaced coincidence with the recessed area of said top portion, so as to force said section of unsevered metal up and generally against the under side of said lid when said bottom portion is inserted into said opening, and a mid-portion interconnecting said top and bottom portions, said mid-portion having (1) a thickness that approximates the thickness of said lid, (2) a planar size that is smaller than the planar size of said bottom portion, and (3) a planar size which approximates the size of said opening, said mid-portion thereby defining a groove generally in the planar shape of said opening that encircles said plug at a position intermediate said top and bottom portions, said mid-portion being adapted to sealingly engage said opening, including said section of unsevered metal, throughout the thickness of said lid.

2. The stopper defined in claim 1 wherein said bottom portion includes a cut-away section that extends generally into said mid-portion at a location that is coincident with said one end of said top portion, to thereby facilitate initial insertion of said one end of said plug into said opening.

3. The stopper defined in claim 2 including a manual actuator extending upward from the top surface of said top plug portion and at the end of said top portion that is generally opposite said one end, said actuator facilitating manual insertion and removal of said plug relative said opening, as said plug rotates generally about the location of said section of unsevered metal.

4. The stopper defined in claim 3 wherein said manual actuator includes a planar surface facilitating the placement of human readable indicia.

5. The stopper defined in claim 5 wherein said plug and said manual actuator are integrally formed as a solid elastomer.

6. The stopper defined in claim 1 wherein said recessed area at said one end of said top portion includes a first recessed area in the top surface of said top portion that is connected to a second recessed area that extends throughout the thickness of said top portion, said second recessed area extending generally into said mid-portion at said one end of said top portion.

7. The stopper defined in claim 6 including a manual actuator extending upward from the top surface of said top plug portion and at the end of said top portion that is generally opposite said one end, said actuator facilitating manual insertion and removal of said plug relative said opening, as said plug rotates generally about the location of said section of unsevered metal.

8. The stopper defined in claim 7 wherein said manual actuator includes a planar surface facilitating the placement of human readable indicia.

9. The stopper defined in claim 8 wherein said manual actuator provides a high friction surface to facilitate said insertion and removal.

10. The stopper defined in claim 9 wherein said plug and said manual actuator are integrally formed as a solid, molded elastomer having a durometer in the range of about 45 to 50.

* * * * *